US007104475B2

(12) United States Patent
Goenka et al.

(10) Patent No.: US 7,104,475 B2
(45) Date of Patent: Sep. 12, 2006

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Visteon Global Technologies, Inc., Van-Buren Township, MI (US)

( * ) Notice: Subject to any disclaimer, the term of this patent is extended or adjusted under 35 U.S.C. 154(b) by 126 days.

(21) Appl. No.: 10/982,593

(22) Filed: Nov. 5, 2004

(65) Prior Publication Data

US 2006/0097082 A1 May 11, 2006

(51) Int. Cl.

| | |
|---|---|
| ***F02M 59/00*** | (2006.01) |
| ***F02M 47/02*** | (2006.01) |
| ***B05B 1/30*** | (2006.01) |
| *F02M 61/00* | (2006.01) |

(52) U.S. Cl. ..... 239/533.2; 239/88; 239/533.12; 239/533.14; 239/585.1; 239/585.5

(58) Field of Classification Search ..... 239/533.2, 239/88, 89, 91, 533.1, 533.14, 533.12, 585.1, 239/585.3, 585.4, 585.5, 596; 251/129.15, 251/129.21, 121

See application file for complete search history.

(56) References Cited

U.S. PATENT DOCUMENTS

| | | | |
|---|---|---|---|
| 3,326,191 | A | 6/1967 | Berlyn |
| 4,018,387 | A | 4/1977 | Erb et al. |
| 4,106,702 | A | 8/1978 | Gardner et al. |
| 4,139,158 | A | 2/1979 | Uehida |
| 4,254,915 | A | 3/1981 | Muller |
| 4,275,845 | A | 6/1981 | Muller |
| 4,346,848 | A | 8/1982 | Malcolm |
| 4,540,126 | A | 9/1985 | Yoneda et al. |
| 4,650,122 | A | 3/1987 | Kienzle et al. |
| 4,666,088 | A | 5/1987 | Krauss et al. |
| 4,801,095 | A | 1/1989 | Banzhaf et al. |
| 4,907,748 | A | 3/1990 | Gardner et al. |
| 5,163,621 | A | 11/1992 | Kato et al. |
| 5,201,806 | A | 4/1993 | Wood |
| 5,244,154 | A | 9/1993 | Buchholz et al. |
| 5,344,081 | A | 9/1994 | Wakeman |
| 5,383,597 | A | 1/1995 | Sooriakumar et al. |
| 5,402,943 | A | 4/1995 | King et al. |
| 5,449,114 | A | 9/1995 | Wells et al. |
| 5,497,947 | A | 3/1996 | Potz et al. |
| 5,533,482 | A | 7/1996 | Naitoh |
| 5,553,790 | A | 9/1996 | Findler et al. |
| 5,570,841 | A | 11/1996 | Pace et al. |
| 5,636,796 | A | 6/1997 | Oguma |
| 5,662,277 | A | 9/1997 | Taubitz et al. |
| 5,685,485 | A | 11/1997 | Mock et al. |
| 5,685,491 | A | 11/1997 | Marks et al. |

(Continued)

FOREIGN PATENT DOCUMENTS

| | | |
|---|---|---|
| EP | WO 93/04277 | 3/1993 |

(Continued)

*Primary Examiner*—Davis Hwu
(74) *Attorney, Agent, or Firm*—Brinks Hofer Gilson & Lione

(57) ABSTRACT

A nozzle for a low pressure fuel injector that improves the control and size of the spray angle, as well as enhances the atomization of the fuel delivered to a cylinder of an engine.

17 Claims, 3 Drawing Sheets

U.S. PATENT DOCUMENTS 5,716,001 A 2/1998 Wakeman et al.
5,716,009 A 2/1998 Ogihara et al.
5,762,272 A 6/1998 Tani et al.
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,168,094 B1 1/2001 Schatz et al.
6,168,095 B1 1/2001 Seitter et al.
6,176,441 B1 1/2001 Munezane et al.
6,257,496 B1 7/2001 Wyant
6,273,349 B1 8/2001 Fischbach et al.
6,279,844 B1 * 8/2001 Shen et al. ..... 239/585.4
6,296,199 B1 10/2001 Noller et al.
6,308,901 B1 10/2001 Nitkiewicz et al.
6,330,981 B1 12/2001 Nally, Jr. et al.
6,394,367 B1 5/2002 Munezane et al.
6,405,945 B1 6/2002 Dobrin
6,439,482 B1 8/2002 Hosoyama et al.
6,439,484 B1 8/2002 Harata et al.
6,494,388 B1 12/2002 Mueller et al.
6,499,674 B1 12/2002 Ren et al.
6,502,769 B1 1/2003 Imoehl
6,513,724 B1 2/2003 Joseph et al.
6,520,145 B1 2/2003 Hunkert
6,533,197 B1 3/2003 Takeuchi et al.
6,547,163 B1 4/2003 Mansour et al.
6,578,778 B1 6/2003 Koizumi et al.
6,581,574 B1 6/2003 Moran et al.
6,616,072 B1 9/2003 Harata et al.
6,626,381 B1 9/2003 Parrish
6,644,565 B1 11/2003 Hockenberger
6,666,388 B1 12/2003 Ricco
6,669,103 B1 12/2003 Tsai
6,669,116 B1 12/2003 Iwase
6,685,112 B1 2/2004 Hornby et al.
6,695,229 B1 2/2004 Heinbuch et al.
6,705,274 B1 3/2004 Kubo
6,708,904 B1 3/2004 Itatsu
6,708,905 B1 3/2004 Borissov et al.
6,708,907 B1 3/2004 Fochtman et al.
6,712,037 B1 3/2004 Xu
6,719,223 B1 4/2004 Yukinawa et al.
6,722,340 B1 4/2004 Sukegawa et al.
6,739,525 B1 5/2004 Dantes et al.
6,742,727 B1 6/2004 Peterson, Jr.
6,758,420 B1 7/2004 Arioka et al.
6,764,033 B1 7/2004 Dantes et al.
6,766,969 B1 7/2004 Haltiner, Jr. et al.
6,783,085 B1 8/2004 Xu
6,817,545 B1 11/2004 Xu
6,848,636 B1 2/2005 Munezane et al.
6,921,022 B1 7/2005 Nally et al.
6,929,196 B1 8/2005 Togashi et al.
6,966,499 B1 11/2005 Nally et al.
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2004/0050976 A1 3/2004 Kitamura
2004/0060538 A1 4/2004 Togashi et al.
2004/0104285 A1 6/2004 Okamoto et al.
2004/0129806 A1 7/2004 Dantes et al.

FOREIGN PATENT DOCUMENTS

EP 0 551 633 A1 7/1993
EP WO 93/20349 10/1993
EP WO 95/04881 2/1995
EP 0 611 886 B1 12/1998
GB 2 232 203 A 5/1990
JP 2-19654 1/1990
JP 5-280442 1/1993
JP 6-221163 8/1994
JP 2001-046919 2/2001

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which increases the spray angle, provides control over the direction of the spray, and enhances atomization of the fuel delivered to a cylinder of an engine. The nozzle generally comprises a nozzle body and a metering plate. The nozzle body defines a valve outlet and a longitudinal axis. The metering plate is connected to the nozzle body and is in fluid communication with the valve outlet. The metering plate defines a nozzle cavity receiving fuel from the valve outlet. The metering plate defines a plurality of exit cavities receiving fuel from the nozzle cavity. Each exit cavity is radially spaced from the longitudinal axis and meets the nozzle cavity at a first exit orifice. A rib projects into the exit cavity and separates an upstream portion and a downstream directing portion of the exit cavity. The rib defines a second exit orifice having a diameter less than the first exit orifice.

According to more detailed aspects, the second exit orifice and downstream directing portion generate a cavitating flow region. The diameter of the second exit orifice is sized relative to the diameter of the downstream directing portion to generate the cavitating flow region. The downstream directing portion has a length to diameter ratio that substantially prevents expansion of the fuel prior to delivery to the cylinder. Preferably, the downstream directing portion is cylindrical, and likewise the upstream portion is preferably cylindrical. Most preferably, the downstream directing portion has a diameter smaller than the upstream directing portion.

According to still further details, each exit cavity defines an exit axis. Each exit axis is tilted in the radial direction relative to the longitudinal axis. In this manner, the exit cavities increase the spray angle of the nozzle. The exit axis is also preferably tilted in a tangential direction relative to the longitudinal axis. In this manner, the exit cavities produce a swirl component to the fuel exiting the nozzle that enhances atomization of the fuel. A variation of the exit cavity may be employed where the upstream portion defines an upstream axis and the downstream directing portion defines a downstream axis. In this variation, the downstream axis is not aligned with the upstream axis. Accordingly, it will be seen that the unique structure of the nozzle permits an increase in the spray angle as well as better control over the direction of the spray. At the same time, the first and second exit cavities, as well as the cavitating flow region, enhance the atomization of the fuel delivered to the cylinder of the engine.

Another embodiment of the present invention provides a nozzle for a low pressure fuel injector generally comprising a nozzle body and a metering plate. The nozzle body defines a valve outlet in a longitudinal axis. The metering plate is connected to the nozzle body and is in fluid communication with the valve outlet. The metering plate defines a nozzle cavity receiving fuel from the valve outlet. The metering plate defines a plurality of exit cavities receiving fuel from the nozzle cavity, each exit cavity being radially spaced from the longitudinal axis. Each exit cavity has a diameter which does not increase along its length. A rib projects into the exit cavity at a point where the exit cavity and nozzle cavity meet. The rib defines an exit orifice having a diameter smaller than the largest diameter of the exit cavity.

According to more detailed aspects, the exit cavity is preferably cylindrical and has a constant diameter. The exit orifice and the exit cavity generate a cavitating flow region which enhances the atomization of the fuel. The rib preferably tapers to a sharp edge to further assist the atomization of the fuel. Each exit cavity defines an exit axis, and each exit axis may be tilted in either or both of the radial direction and the tangential direction relative to the longitudinal axis. In this manner, the spray angle of the nozzle may be increased, and a swirl component may be introduced into the fuel exiting the nozzle to enhance atomization.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
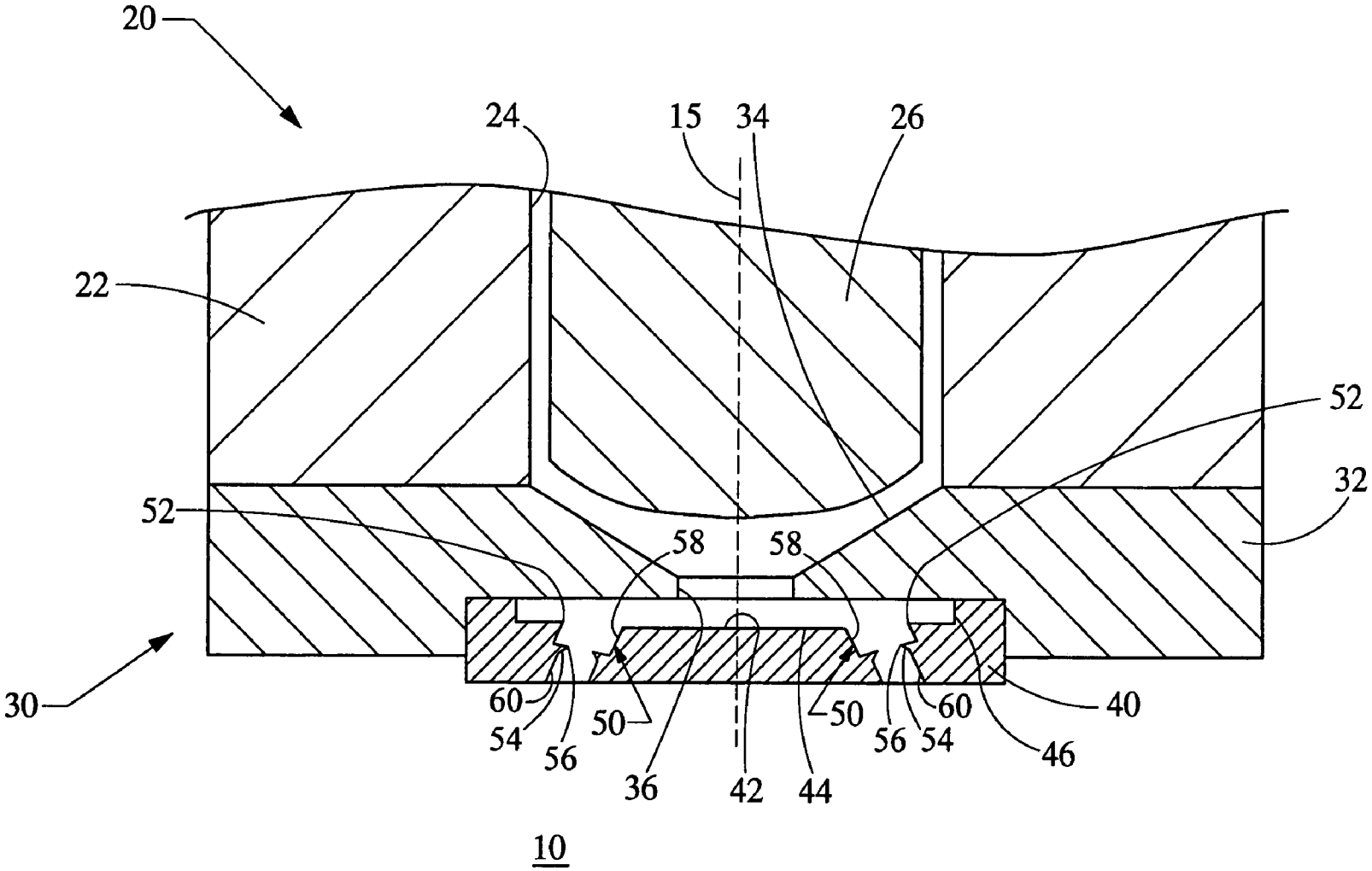
FIG. 1 depicts a cross-sectional view, partially cut-away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

Figure 2:
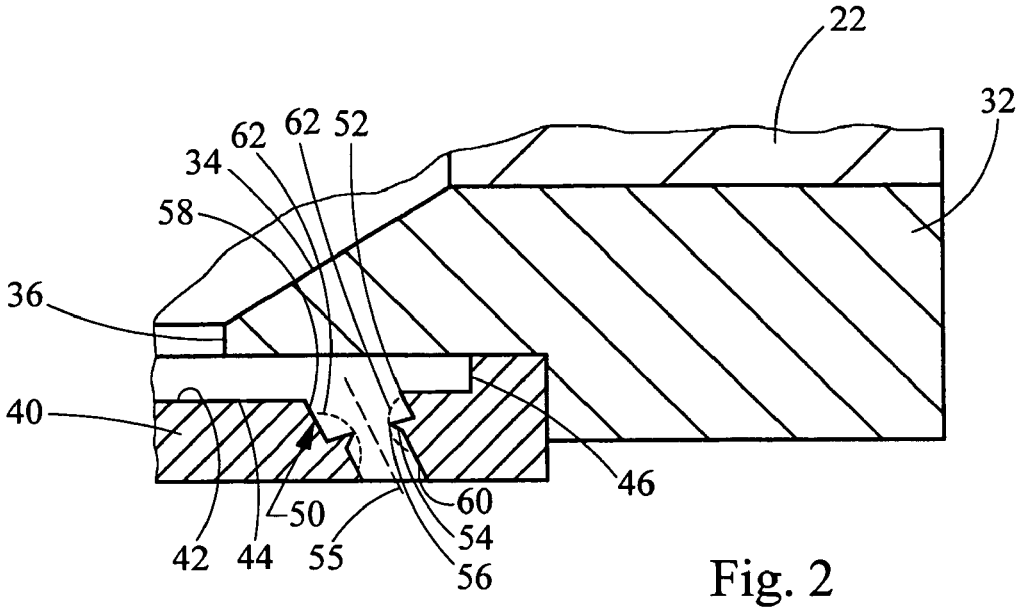
FIG. 2 depicts an enlarged cross-sectional view, partially cut-away, of the nozzle depicted in FIG. 1.
Figure 3:
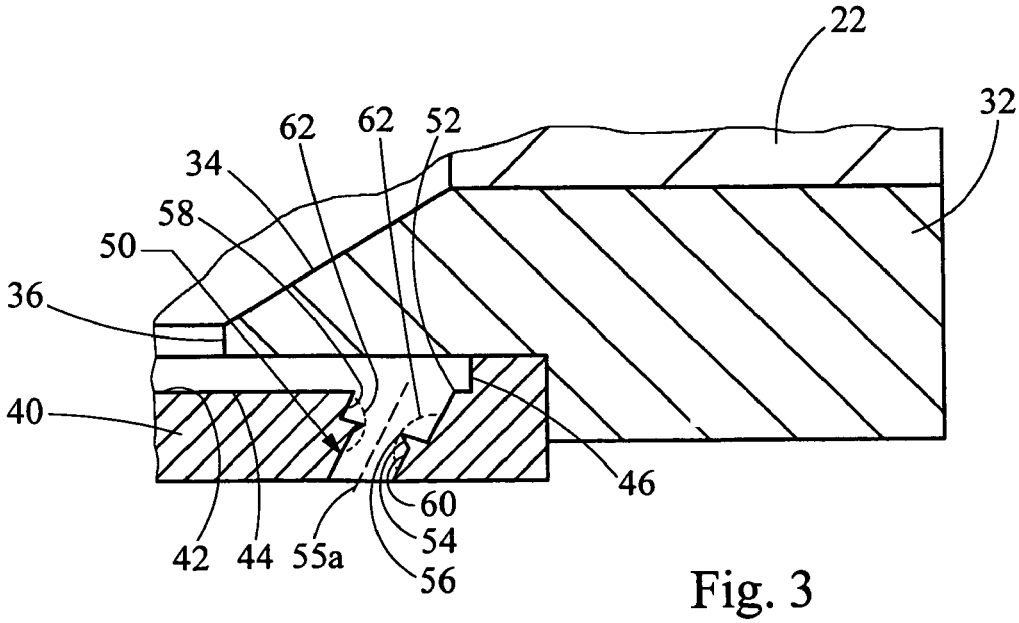
FIG. 3 depicts an enlarged cross-sectional view, partially cut-away, taken about the line 3—3 in FIG. 2.

It can also be seen in FIG. 1 that the metering plate 40 has been uniquely designed to increase the spray angle, improve control over the direction of the spray, as well to enhance atomization of the fuel flowing through the metering plate 40 that is delivered to the cylinder 10 of an engine. With reference to FIGS. 1–3, each exit cavity 50 includes a rib 54 projecting inwardly into the cavity 50. Preferably the rib 54 tapers to a sharp edge which defines a second exit orifice 56. This second sharp edged orifice 56 further enhances the turbulence of the fuel flowing thereby and thereby enhances atomization of the fuel.

The rib 54 and the second exit orifice 56 also divides the exit cavity 50 into an upstream portion 58 and a downstream directing portion 60. The downstream directing portion 60 is preferably cylindrical in shape, and at least has a diameter which does not substantially increase along its length. Most preferably, the downstream directing portion 60 has a diameter that is smaller than the upstream portion 58. Further, the downstream directing portion 60 has a length to diameter ratio that substantially prevents expansion of the fuel prior to delivery to the cylinder 10. That is, when an exit cavity widens towards the cylinder 10 for directing the same, it provides relief to the fuel accelerating through nozzle cavity 42 and metering plate 40 which allows the fuel to expand as it enters the cylinder 10. In this manner, the downstream directing portion 60 will serve to prevent expansion and allow the exit cavity 50 to direct the spray of the fuel.

The structure of the exit cavity 50, and notably the rib 54 and upstream and downstream portions 58, 60, produce a cavitating flow region 62 in the area adjacent the rib 54. As such, the fuel flowing therethrough is forced to accelerate in the area adjacent this cavitating flow region 62 which enhances a turbulence of the fuel, thereby increasing atomization. The diameter of the second exit orifice 56 is preferably sized relative to the diameter of the downstream directing portion 60 to generate this cavitating flow region 62.

By directing the spray of the fuel through the downstream directing portion 60, not only can the spray be better controlled in its direction, but the spray angle of the fuel flowing through the nozzle 20 may also be increased. Specifically, the exit cavity 50 generally defines an exit axis 55. Each exit axis 55 is preferably tilted in the radial direction relative to the longitudinal axis 15 to increase the spray angle of the nozzle 20.

As best seen in FIG. 3, the exit axis 55 is also preferably tilted in the tangential direction relative to the longitudinal axis 15. In this manner, the orientation of the exit cavity 50 along its exit axis 55 results in a swirl component being provided to the fuel exiting the metering plate 40 and nozzle 20. This swirl component further enhances the atomization of the fuel, while at the same time increasing the spray angle of the nozzle 20.

Figure 4:
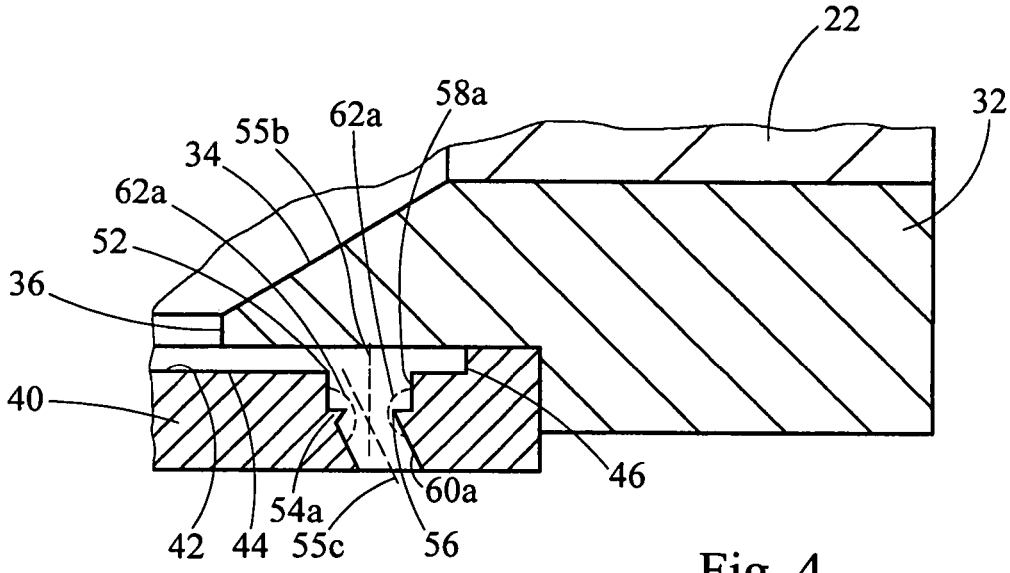
FIG. 4 depicts an enlarged cross-sectional view, partially cut-away, of an alternate embodiment of the nozzle depicted in FIGS. 1–3.

Turning now to FIG. 4, an alternate embodiment of the nozzle 20 has been depicted. In particular, the metering plate 40*a* includes a plurality of exit cavities of 50*a* of slightly different structure. The rib 54*a* projects into the cavity 50*a* and divides the upstream portion 58*a* from the downstream directing portion 60*a*. However, it will be recognized that the upstream portion 58*a* has an upstream axis 55*b*, which differs from a downstream axis 55*c* of the downstream directing portion 60*a*. Accordingly, it will be recognized by those skilled in the art that by permitting the downstream axis 55*c* of the downstream directing portion 60*a* to vary in direction, the direction of the spray can be better controlled, as well as permitting an increase in the spray angle of the fuel delivered to the cylinder by the nozzle 20 through the metering plate 40*a*.

Figure 5:
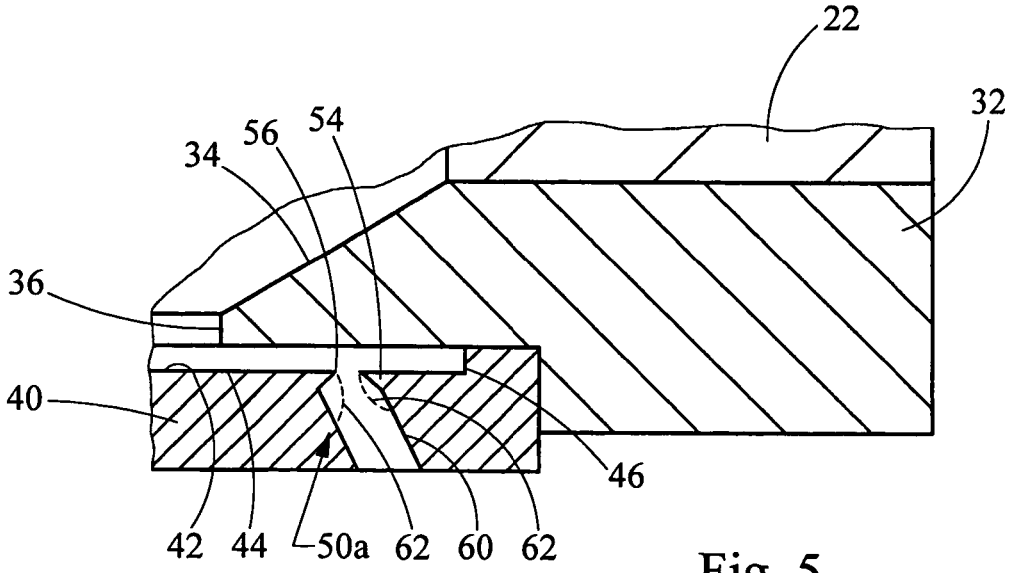
FIG. 5 depicts an enlarged cross-sectional view, partially cut-away, of yet another embodiment of the nozzle depicted in FIGS. 1–3.

Turning now to FIG. 5, another embodiment of the nozzle 20 illustrates another version of the metering plate 40*b*. In particular, the metering plate 40*b* includes a plurality of exit cavities 50*b* which have a rib 54*b* projecting into the exit cavity 50*b* at a point where the exit cavity 50*b* and the nozzle cavity 42 meet. Thus, a single exit orifice 56*b* is defined at this location. The exit orifice 56*b* has a diameter smaller than the largest diameter of the exit cavity 50*b*, and in particular its downstream directing portion 60*b*. Preferably the exit cavity 50*b* is cylindrical and has a constant diameter, although the exit cavity 50*b* and its downstream directing portion 60*b* can taper so that it has a diameter which does not increase along its length. The exit cavity 50*b* and the rib 54*b* still produce a cavitating flow region 62*b* which enhances the turbulence of the fuel and thereby improves atomization of the fuel.

As in the prior embodiments, the exit cavity 50*b* preferably is oriented along an exit axis which is tilted in the radial direction and/or the tangential direction to increase the spray angle as well as produce a swirl component to the fuel exiting the nozzle 20 and entering the engine cylinder 10. In this manner, the upstream portion of the exit cavity may be eliminated, while still providing a cavitating flow region and sharp edged orifice which enhance turbulence of the fluid, while allowing control over the direction of the spray to be performed through the downstream directing cavity 60*b*. Further, the structure and orientation of each exit cavity, in concert with the plurality of exit cavities, enhances the spray angle and control over the direction of the spray.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby. enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of exit cavities receiving fuel from the nozzle cavity, each exit cavity is radially spaced from the longitudinal axis meets the nozzle cavity at a first exit orifice; and a rib projecting into the exit cavity and separating an upstream portion and a downstream directing portion of the exit cavity, the rib defining a second exit orifice having a diameter less than the first exit orifice.

2. The nozzle of claim 1, wherein the second exit orifice and downstream directing portion generate a cavitating flow region.

3. The nozzle of claim 2, wherein the diameter of the second exit orifice is sized relative to the diameter of the downstream directing portion to generate the cavitating flow region.

4. The nozzle of claim 1, wherein the downstream directing portion has a length to diameter ratio that substantially prevents expansion of the fuel prior to delivery to the cylinder.

5. The nozzle of claim 1, wherein the downstream directing portion is cylindrical.

6. The nozzle of claim 1, wherein the upstream portion is cylindrical.

7. The nozzle of claim 1, wherein the rib tapers to a sharp edge.

8. The nozzle of claim 1, wherein the downstream directing portion has a diameter smaller than the upstream portion.

9. The nozzle of claim 1, wherein each exit cavity defines an exit axis, each exit axis being tilted in the radial direction relative to the longitudinal axis to increase the spray angle of the nozzle.

10. The nozzle of claim 1, wherein each exit cavity defines an exit axis, the exit axis being tilted in the tangential direction relative to the longitudinal axis to produce a swirl component to the fuel exiting the nozzle.

11. The nozzle of claim 1, wherein the upstream portion defines an upstream axis, and wherein the downstream directing portion defines a downstream axis, and wherein the downstream axis is not aligned with the upstream axis.

12. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of exit cavities receiving fuel from the nozzle cavity, each exit cavity being radially spaced from the longitudinal axis, each exit cavity having a diameter which does not increase along its length in the downstream direction; and a rib projecting into the exit cavity at a point wherein the exit cavity and nozzle cavity meet, the rib defining an exit orifice having a diameter smaller than the largest diameter of the exit cavity.

13. The nozzle of claim 12, wherein the exit cavity is cylindrical and has a constant diameter.

14. The nozzle of claim 12, wherein the exit orifice and exit cavity generate a cavitating flow region.

15. The nozzle of claim 12, wherein the rib tapers to a sharp edge.

16. The nozzle of claim 12, wherein each exit cavity defines an exit axis, each exit axis being tilted in the radial direction relative to the longitudinal axis to increase the spray angle of the nozzle.

17. The nozzle of claim 12, wherein each exit cavity defines an exit axis, the exit axis being tilted in the tangential direction relative to the longitudinal axis to produce a swirl component to the fuel exiting the nozzle.

* * * * *